US005444894A

United States Patent [19]

Heiler

[11] Patent Number: 5,444,894

[45] Date of Patent: Aug. 29, 1995

[54] VEHICLE DOOR HINGE WITH INTEGRATED CHECK

[75] Inventor: Cornelius T. Heiler, Detroit, Mich.

[73] Assignee: Chrysler Corporation, Highland Park, Mich.

[21] Appl. No.: 173,225

[22] Filed: Dec. 27, 1993

[51] Int. Cl.[6] ..... E05D 7/10

[52] U.S. Cl. ..... 16/262; 16/257; 16/344

[58] Field of Search ..... 16/262, 261, 270, 257, 16/254, 366, 368, 369, 82, 86 B, 86 C, 344, DIG. 21, 380

[56] References Cited

U.S. PATENT DOCUMENTS

| | | | |
|---|---|---|---|
| 2,513,751 | 7/1950 | Semar | 16/85 |
| 4,432,675 | 8/1985 | Salazar | 16/335 |
| 4,720,895 | 1/1988 | Peebles | 16/344 |
| 4,765,025 | 8/1988 | Salazar | 16/380 |
| 4,807,331 | 2/1989 | Calucci | 16/262 |
| 4,833,755 | 5/1989 | Bonin | 16/344 |
| 4,864,687 | 9/1989 | Calcaterra et al. | 16/237 |
| 4,881,298 | 11/1989 | Turnbull | 16/380 |
| 5,054,165 | 10/1991 | Marchione | 16/254 |
| 5,067,201 | 11/1991 | Marchione | 16/270 |
| 5,074,010 | 12/1991 | Gignac | 16/334 |
| 5,152,030 | 10/1992 | Cogo | 16/86 |
| 5,297,314 | 3/1994 | Bender et al. | 16/270 |

*Primary Examiner*—Mark Rosenbaum
*Assistant Examiner*—Chuck Y. Mah
*Attorney, Agent, or Firm*—Christopher A. Taravella

[57] ABSTRACT

A three piece lift-off hinge assembly for a vehicle door comprising a door-half hinge plate and a body-half hinge sub-assembly incorporating an integrated track member and track guide type hold-open door check mechanism. The hinge assembly enables the vehicle door and the door-half hinge plate to be readily removed and re-attached from the body-half hinge subassembly and the vehicle body, such as during an assembly line operation, without disassembling the hold-open door check mechanism.

10 Claims, 5 Drawing Sheets

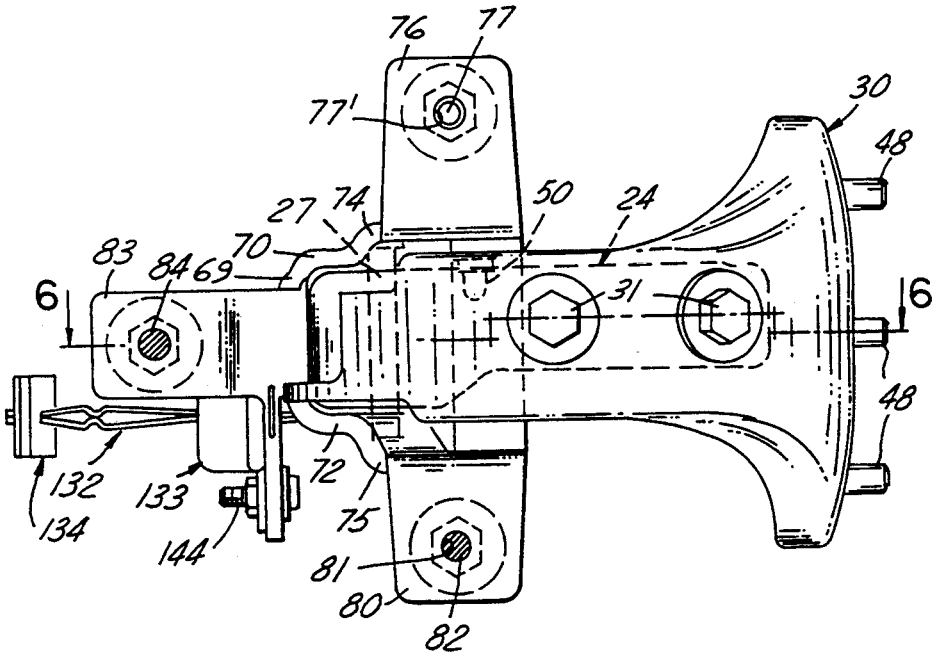
FIG.4
FIG.5
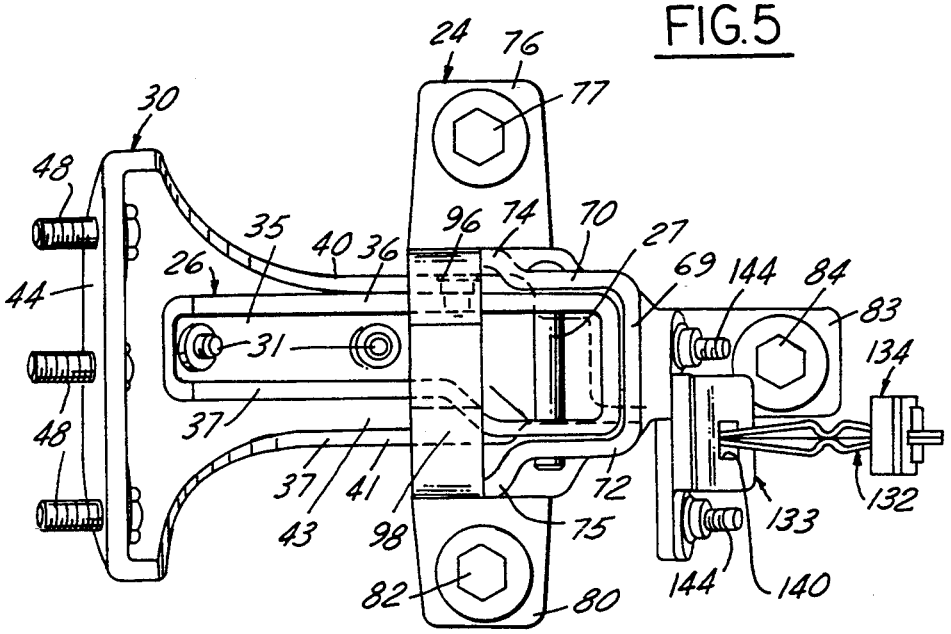

(DOOR CLOSED)

(DOOR OPEN)

VEHICLE DOOR HINGE WITH INTEGRATED CHECK

BACKGROUND OF THE INVENTION

This invention relates generally to automobile door hinges and, more particularly, to a three-piece lift-off door hinge assembly incorporating an integrated hold-open door check arrangement.

It is well known in the automotive industry to form a three piece separable automobile door hinge assembly. An example of one such hinge is shown in Calcaterra et al. U.S. Pat. No. 4,864,687 entitled Three Piece Door Hinge issued Sep. 12, 1989 enabling a vehicle door to be readily removed and rehung during an assembly line operation. Calucci U.S. Pat. No. 4,807,331 issued Feb. 28, 1989 entitled Door Lift-Off Hinge discloses another three piece door hinge assembly which provides self-alignment reception of the pivot pin within a leaf hinge hole of the door-half member.

The present invention concerns providing a three piece lift-off automobile door hinge assembly having an integrated hold-open door check arrangement. Marchione U.S. Pat. No. 5,054,165 issued Oct. 8, 1991, entitled Door On-Door Off Vehicle Hinge With Hold-Open Mechanism, concerns a three piece separable hinge which includes a plunger-type hold-open mechanism that remains in its entirety with the vehicle body when the door is removed.

Bonin U.S. Pat. No. 4,833,755 issued May 30, 1989 discloses a system for marking a vehicle door with respect to a vehicle body upright. A lever is articulated by one of its ends to the vehicle body and a guide disposed on the door in the vicinity of the articulation of the lever in the door closed position and being in abutment against the other end of the lever with the door in its fully open position.

Salazar U.S. Pat. No. 4,532,675 issued Aug. 6, 1985 entitled Door Hinge With Integral Check discloses a two piece door hinge assembly with a leaf spring type hold-open device carried on the hinge body plate and a roller carried in a cage portion of the hinge door plate which engages the leaf spring only during the portion of travel proximate the door open position.

SUMMARY OF THE INVENTION

It is the object of the present invention to provide a three piece lift-off hinge assembly for a vehicle door incorporating a track and guide type hold-open check mechanism operative, upon door opening and closing, for providing passage of a track member through a body-half hinge plate guide device and aligned plate aperture wherein the mechanism remains with the vehicle body-half hinge plate when the door is removed and re-attached.

It is another object of the present invention to provide a three piece lift-off hinge assembly as set forth above wherein the hinge assembly comprises a body-half hinge subassembly in the form of a body-half hinge plate pivotally connected to a link plate and wherein the sub-assembly, which carries the check mechanism, is readily separable from a liftoff door-half hinge plate and door.

It is a still further feature of the present invention to provide a vehicle door three piece lift-off hinge assembly as set forth above which is adapted for use with an "out-swinging" type vehicle door.

BRIEF DESCRIPTION OF THE DRAWINGS

These and other objects, features and advantages of the invention will appear from the following written description and the accompanying drawings in which:

FIG. 4 is a fragmentary view of the upper hinge assembly taken on the line 4—4 of FIG. 3;

FIG. 5 is a fragmentary view of the upper hinge assembly taken on the line 5—5 of FIG. 3;

DETAILED DESCRIPTION OF THE INVENTION

Figure 1:
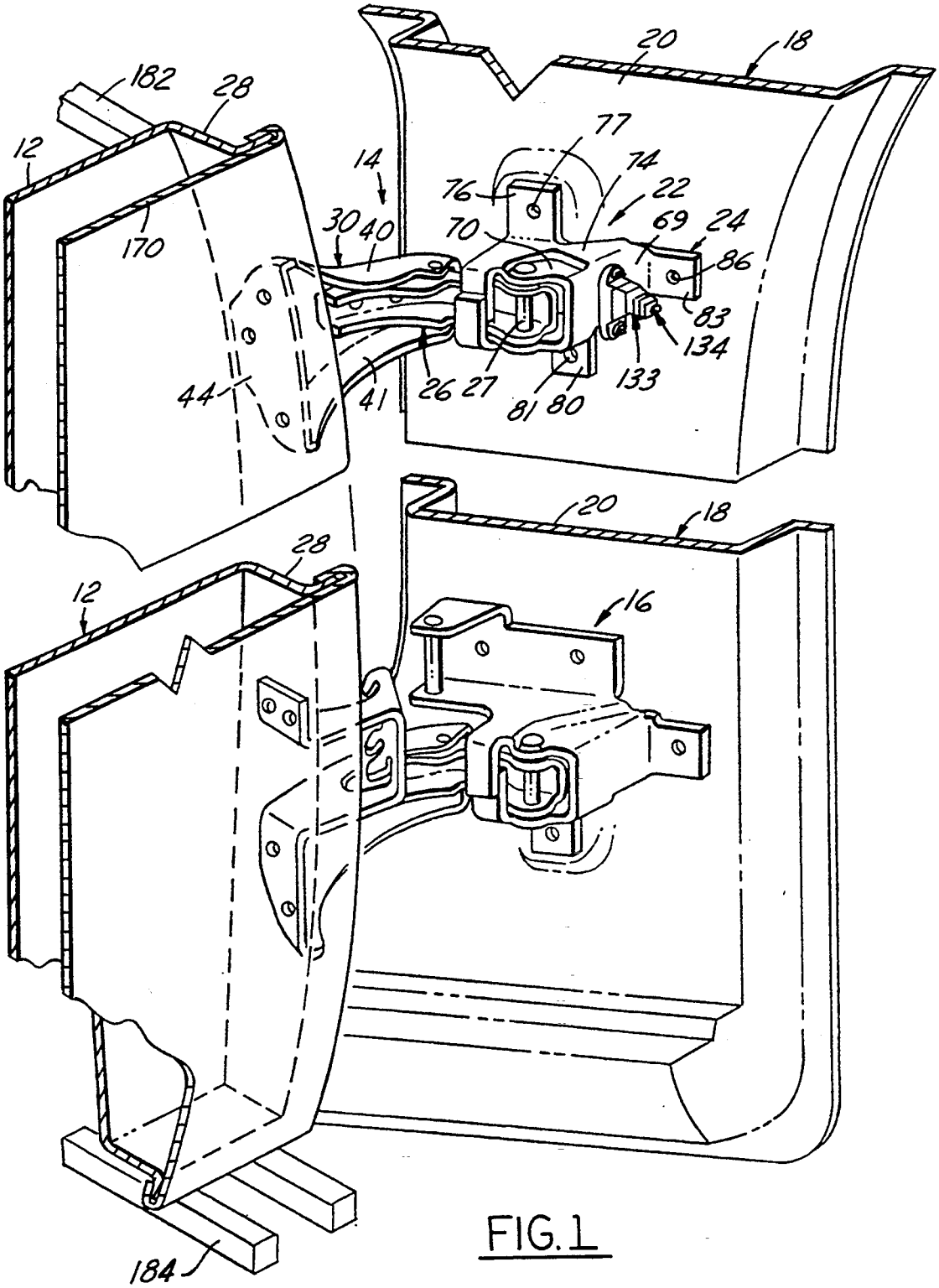
FIG. 1 is a fragmentary perspective view of showing a vehicle right hand door showing upper and lower hinge assemblies with the door swung to a partially open position.

Referring now to the drawings and in particular to FIG. 1, there is shown a portion of a right hand passenger side door 12 wherein an upper readily separable three piece hinge assembly 14 and a lower readily separable three piece hinge assembly 16 are depicted supporting the door 12 in a partially open position on a vehicle body hinge post or pillar 18. As the lower hinge assembly 16 is not a part of the instant invention, only the upper hinge assembly 14 will be described in the present application. Reference may be had to co-pending application entitled Vehicle Door Hinge With Interlock, having a Ser. No. 08/173,232, filed Dec. 27, 1993.

Figure 6:
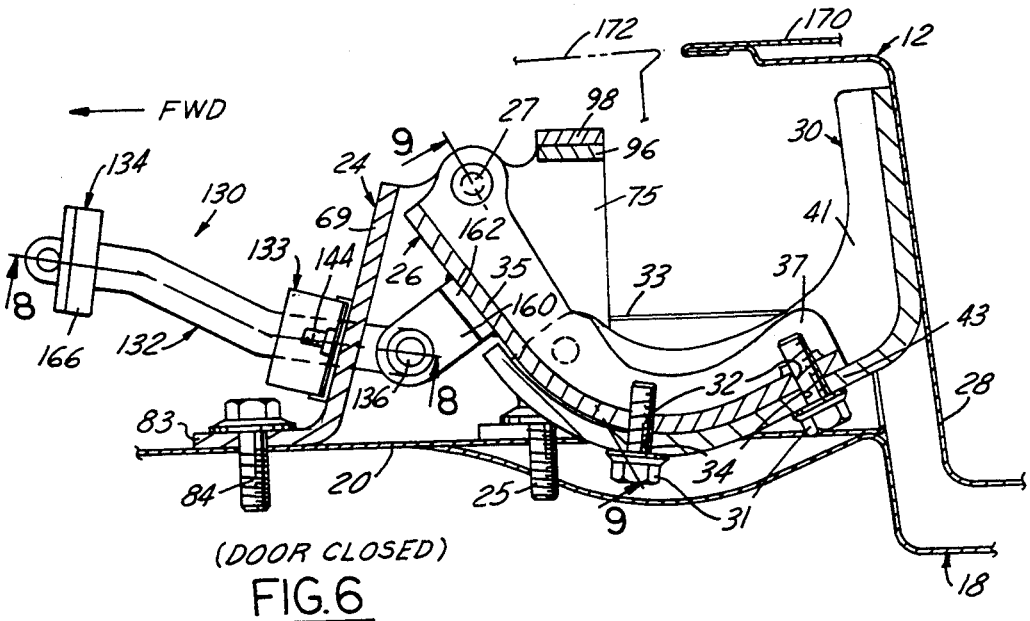
FIG. 6 is a fragmentary horizontal view, partly in section, taken substantially on the line 6—6 of FIG. 4 showing the upper hinge assembly in its door closed position.

FIG. 1 shows a vehicle body door pillar panel 20 supporting an upper body-half hinge sub-assembly 22 comprising a body-half mounting plate 24 and a link plate 26 pivotally connected by a fastener shaft 27. Upright door edge panel 28 is shown supporting an upper door-half mounting plate 30 of the hinge assembly 14. FIG. 6 depicts the door-half mounting plate 30, having a generally U-shape or outwardly opening channel section when viewed in vertical cross-section, releasably secured to the link plate 26 by bolts 31 extending through holes 32 in link plate bight wall 33 aligned with associated holes 34 in vertically disposed bight wall 35 of the link plate 26. The link plate has upper 36 and lower 37 parallel horizontally disposed flanges extending from its bight wall 35.

Figure 9:
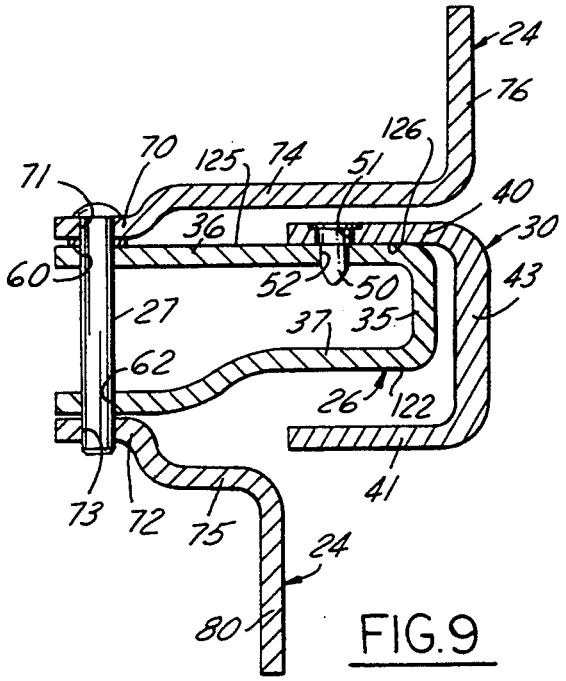
FIG. 9 is an enlarged fragmentary vertical sectional view taken on the line 9—9 of FIG. 6.

As seen in FIG. 9, the door-half mounting plate 30, having a generally U-shape or outwardly opening channel section when viewed in vertical cross-section, is formed with an upper flange 40 and a lower flange 41 horizontally disposed in parallel relation joined by a vertically disposed bight wall 43. The door-half mounting plate 30 has an end cap 44 (FIG. 2) adapted to be fixed on upstanding door edge panel 28 by bolts 48

(FIG. 5) extending through mounting holes 46 in the end cap 44.

Figure 7:
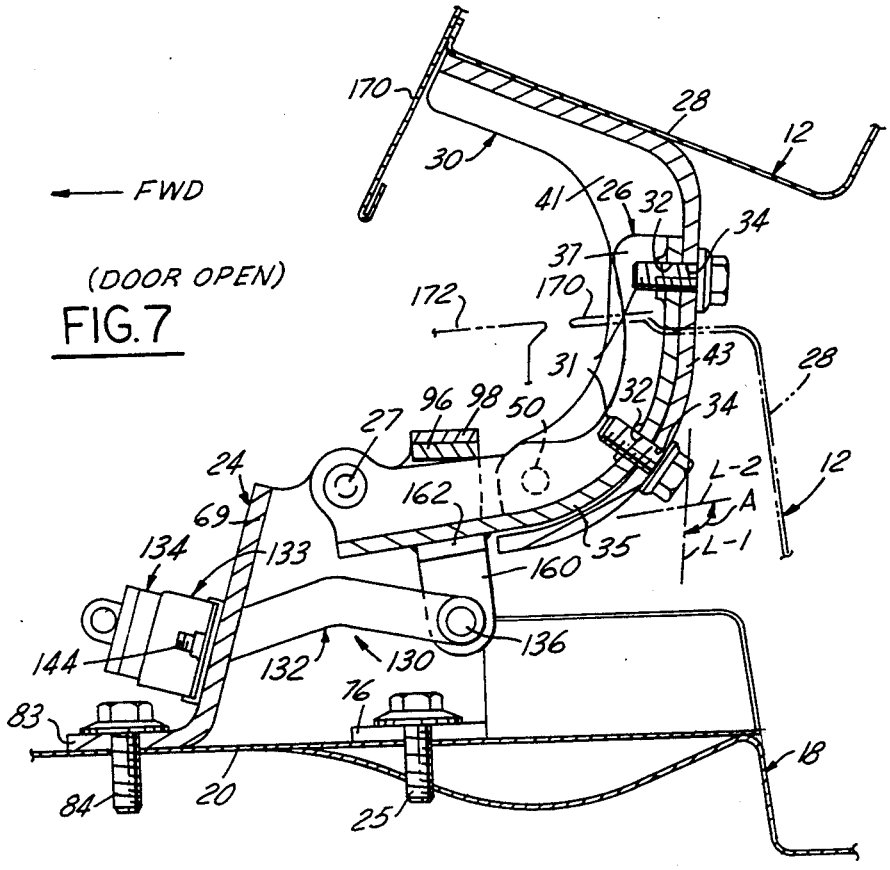
FIG. 7 is a fragmentary horizontal view similar to FIG. 6 showing the lower hinge in its door open position.

As best seen in FIG. 7, the link plate also has a generally U-shape or outwardly opening channel section when viewed in vertical cross-section defining a vertically disposed bight wall 35. The bight wall 35 is arcuate shaped in plan having a pair of tangent end portions disposed at an obtuse angle "A" of about 110 degrees, indicated by intersecting tangent construction lines L-1 and L-2. The tangent end portions are joined by an intermediate radiused portion. Further, the door-half hinge plate bight wall 43 has an arcuate shape also defined by a pair of tangent end portions disposed at the same obtuse angle "A" whereby the link plate bight wall 35 exterior surface nests in a complementary manner juxtaposed the inner surface of the door mounting plate bight wall 43. As seen in FIG. 5, when assembled in a nested manner, the link plate 26 has an upper horizontal exterior surface of its upper flange 36 in flush mating contact with horizontal interior undersurface of the door-half hinge plate upper flange 40.

Figure 2:
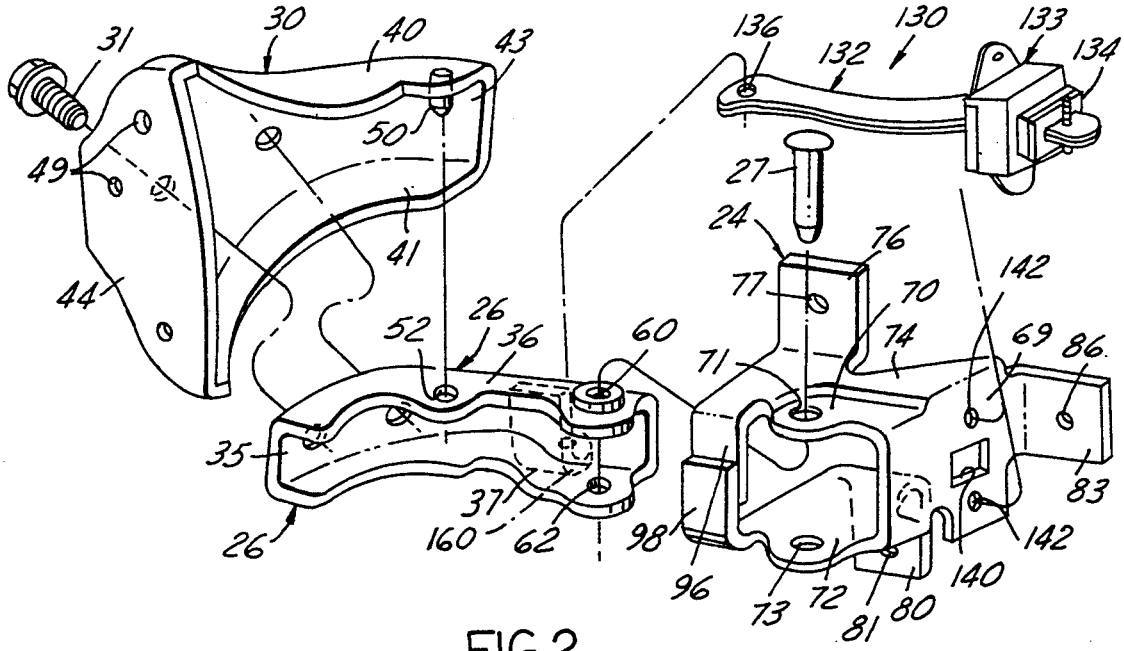
FIG. 2 is an exploded perspective view of the upper hinge assembly of the present invention FIG. 1.
Figure 3:
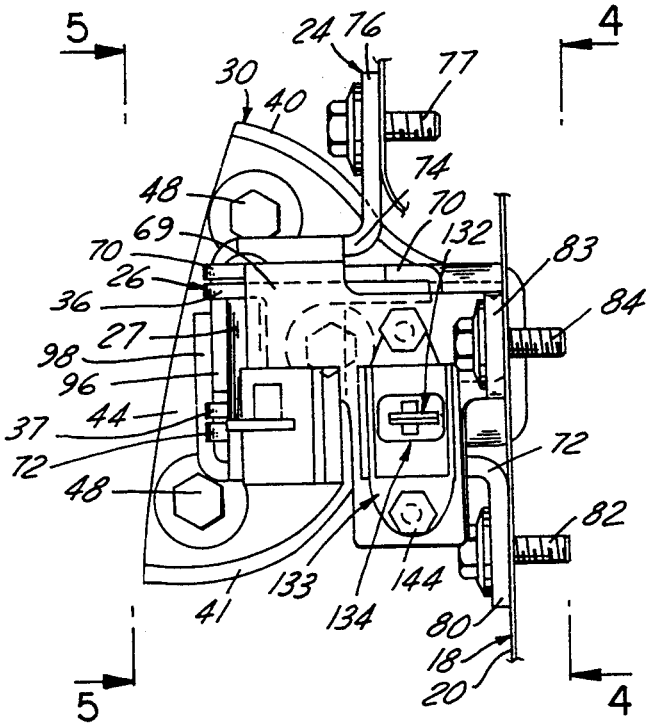
FIG. 3 is a fragmentary side view showing the upper hinge assembly oriented relative to the vehicle door.

FIG. 9 shows the door-half hinge plate upper flange 40 having a cylindrical coupling dowel 50 staked in hole 51 such that the dowel 50 extends vertically downwardly therefrom with its lower end rounded in a bullet-like manner. An intermediate portion of the link plate upper flange 36 is provided with a coupling dowel hole 52 sized for sung reception of the door plate coupling dowel 50. The dowel 50 is sized so as to obviate radial play upon the flush contact of the door-half hinge plate upper flange 40 interior surface with an opposed exterior upper surface of the link plate upper flange 36. With reference to FIG. 2, the link plate upper flange 36 has its one end provided with a hinge pin hole 60 vertically aligned with hole 62 in its lower flange 37 for the reception of hinge pin 66.

The body-half hinge plate 24 is generally U-shaped having an upper flange 70 formed with a hinge pin hole 71 and a lower flange 72 formed with hinge pin hole 73. FIG. 9 shows the upper 71 and lower 73 holes vertically aligned for the reception of hinge pin 27 upon one hinge pin end of the link plate 26 being received in a close fit manner between the upper 70 and lower 72 flanges of the body-half mounting plate 24.

The body-half mounting plate has an upper flange portion 74 upwardly offset out of the plane of its upper flange 70 while its lower flange 72 (FIG. 5) has an downwardly offset portion 75 formed out of the plane of the lower flange 72. The body-half upper flange 70 has an upstanding body mounting edge rib 76 provided with a hole 77 for a bolt 77' while its lower flange 72 has a downstanding mounting tongue 80 provided with a hole 81. The bolts 77' and 82 are adapted for attachment to vehicle body panel 20.

As seen in FIGS. 2 and 6, the body-half hinge plate 24 vertically disposed bight wall 44 is formed with an angled leaf 83 adapted for flush contact with the door pillar body panel 20 by means of a bolt 84 received in hole 86 (FIG. 2). A pair of upper and lower vertically disposed straps 96 and 98 are bent at right angles out of the plane of their associated upper and lower offset flanges 74 and 72, respectively. The straps 96 and 98 are configured such that their respective opposed inner and outer surfaces are juxtaposed for suitable connected, as by welding, to rigidify the body-half plate member 24.

Means are provided for readily coupling the door-half hinge plate 30, secured to the door edge panel 12, to the link plate 26 by means of the dowel 50. As seen in FIGS. 1 and 7, the body-half sub-assembly 22 fixed on the vehicle body panel 20 and the link plate 26 pivoted to its maximum full open position wherein link plate lower flange 37 contacts an inner surface of the lower strap 98.

Figure 9A:
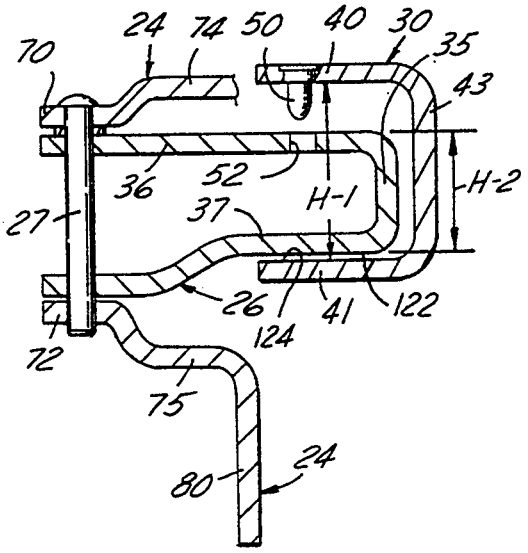
FIG. 9A is a view similar to FIG. 9 showing an intermediate step in the door lift-off hinge arrangement.

With reference to FIG. 9A, the door-half hinge plate 30 is moved laterally until the inner surface of its bight wall 43 is conforming nested juxtaposed relation with an outer surface of the link plate bight wall 35 and an exterior undersurface 122 of the link plate 26 is juxtaposed with an upper internal surface 124 of the door-half hinge plate lower flange 41. It will be noted in FIG. 9A that the internal height defined by interior opposed surfaces of door-half hinge plate flanges 40 and 41 is a first predetermined dimension "H-1". Further, the exterior height defined by the opposite exterior surfaces of the link plate flanges 36 and 37 is a second predetermined dimension "H-2". It will be appreciated from FIG. 9A that the height "H-1" exceeds the height "H-2" by a determined dimension which is greater than the vertical extent of the dowel 50. This arrangement enables the link plate to initially clear the coupling dowel 50, as seen in FIG. 9A. Thus, upon the door 12 being positioned as shown in FIG. 9A, with the dowel 50 in vertical alignment with the link plate upper flange hole 52, the door is lowered vertically downward to its position of FIG. 9 wherein the dowel is snugly positioned in the link plate hole 52 such that link plate upper surface 125 is in flush contact with door-half hinge plate upper flange interior surface 126. With the plates 26 and 30 coupled by the dowel 50, the link plate and door-half hinge plate are positioned for positive interlocked connection by threadably securing the pair attaching bolts 32.

With reference now to FIGS. 2, 6, and 7, it will be seen that a door check or hold-open mechanism, indicated generally at 130 in FIG. 2, comprises an elongated track member 132 shown extending thorough a roller guide device 133. Track member has a stop arrangement 134 on its outboard free end and a pair of aligned attaching holes 135 on each inboard end journalled on a shaft axis of a rivet fastener 136. The track member 132 is defined by upper and lower mirror image tracks 137 having inner opposed surfaces at their outboard and inboard ends suitably secured as by spot welds.

Figure 8:
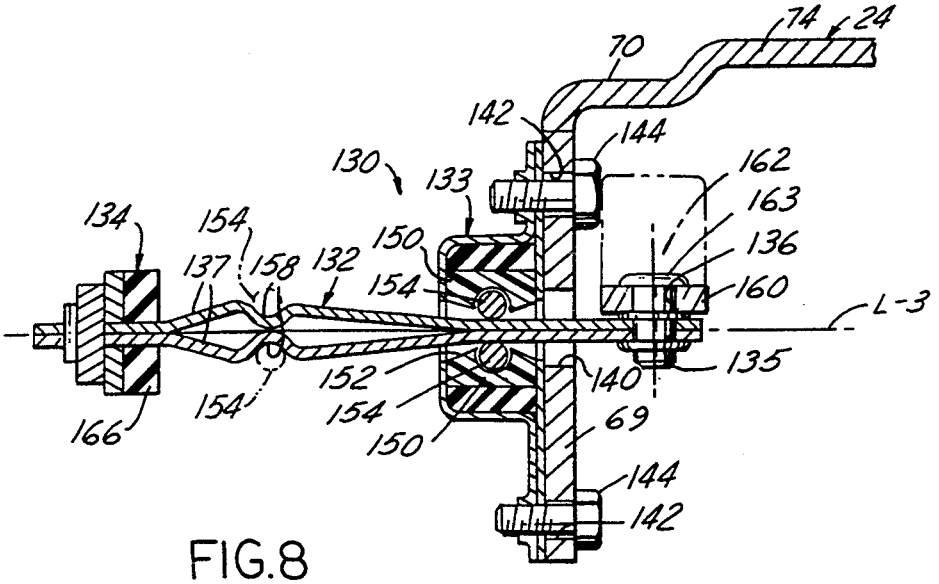
FIG. 8 is a horizontal sectional view taken on the line 8—8 of FIG. 6.

FIG. 2 shows the body-half Binge plate bight Wall 69 formed with a rectangular opening 140 having upper and lower attaching holes 142, for bolts 144, disposed on the vertical axis of symmetry of the rectangular opening 140. As best seen in FIG. 8, the roller guide device 134 comprises a pair of upper and lower mirror image resilient blocks 150 vertically spaced about a horizontally disposed plane of symmetry indicated by construction line "L-3". The blocks 150 each have a pair of opposed mutually converging faces 152 with each pair of faces 152 terminating in a semi-circular transversely extending pocket journally supporting a detent roller 154 therein. The rollers 154 are vertically spaced so as to engage an exterior surface of an associated upper and lower resilient track member 132.

It will be noted that each track 137 is formed with at least one detent roller concave receptacle 158 adapted to engage its associated roller 154 when the door 12 is pivoted to a predetermined intermediate open position. The door check mechanism 130 also provides a full-open position by means of its end stop arrangement 134.

Each track 137 is made from suitable metal leaf spring material and is formed with opposite sloped lead-in ramps on either side of its associated concave trough or receptacle 158. Applicant's invention does not involve the specific details of the conventional "checker" mechanism 130, as such sliding track and guide roller mechanisms of this general type are in general use. An example of one such "checker" mechanism is disclosed in Gignac et al. U.S. Pat. No. 5,074,010 issued Dec. 24, 1991 entitled Vehicle Door Check Mechanism and reference may be made to the '010 patent for a detailed description thereof.

With reference to FIGS. 2, 6 and 8, it will be seen that the hinge link plate 26 has a door check track attaching tab or bracket member 160. The bracket member 160 in the disclosed embodiment is shown as an L-shaped bracket suitably secured as by welding bracket upstanding angle flange 162 to the closed or exterior surface of the link bight wall 35 adjacent its one distal end. The bracket tab 160 has a hole 163 adapted for alignment with track member hole 135 for journalled reception of the rivet fastener 136.

Thus, when it is desired to open the door 12 to a predetermined position, shown in FIG. 7, the door is pivoted about the axis of hinge assembly pivot pin 27 from the body pillar 18. The upper and lower guide rollers 154 ride on the track member 132 until captured in their associated troughs 158 as shown by each roller's dashed-lined position in FIG. 8. It will be appreciated that if the door is pivoted to its full open position upon the rollers 154 over-ride the troughs 158 causing resilient pad 166 of the stop arrangement 134 to contact an opposed face of the guide device 133.

It will be appreciated that upon the pair of hinge assembly take-apart bolts 31 being unthreaded from the link plate holes 32 the door-half hinge plate 30 and door 12 may be removed from the vehicle and re-mounted without requiring any disassembly of the door hold-open check mechanism 130.

It will be further noted in FIG. 7 that the hinge assembly 14 of the present invention is a "swing-out" type of vehicle door hinge. Thus, in its full-open FIG. 7 position, door outer panel 170 is shown pivoted outboard of its associated vehicle side or fender panel shown in dashed lines at 172. This arrangement is to be contrasted with a "swing-in" type vehicle doors as shown, for example, in the above mentioned Calcaterra et al. or Marchione patent. Applicant's unique three-piece hinge design, wherein the link plate 26 bight wall 35 has a central arcuate shaped portion, which when viewed in plan, terminates at each free end in a linear tangent-like section. The link plate bight wall linear sections define an obtuse central angle of the order of 110 degrees which matches the obtuse central angle "A" (FIG. 7) defined by the linear bight wall portions of the door-half hinge plate 30 allowing the nested assembly.

It will be appreciated in FIG. 8 that the assembled obtuse angled profile of the nested arcuate-shaped link plate 26 and door-half hinge plate 30 assembly allow "out-swinging" door 12 to swing relative to its associated vehicle body side panel 172 so as to be positioned outboard of its associated side panel or fender 172. Applicant's three-piece out-swinging door hinge arrangement allows its use with a vehicles body having an outer shell or skin formed with an aerodynamically rounded profile.

Applicant's hinge is adapted for use with automated door conveying means such as a robot, indicated schematically by robot arms 182 and 184 in FIG. 1. Reference may be made to Sekiraku U.S. Pat. No. 4,685,208 disclosing one form of automated apparatus suitable for use with the invention, the disclosure of which is incorporated by reference herein.

While a preferred embodiment of the invention has been illustrated and described, this is only for purposes of illustration. It is, therefore, to be understood that within the scope of the appended claims, the invention may be practiced otherwise than as specifically described.

What is claimed is:

1. A three piece hinge assembly for mounting a door for swinging between open and closed positions on the body of a vehicle, said hinge assembly comprising a combination of a body-half hinge sub-assembly providing a body-half hinge mounting plate and a link plate, a door-half hinge mounting plate, means for securing said body-half plate and door-half plate to the body and the door, respectively, a hinge pin for pivotally connecting said link plate to the body-half plate, means for detachably connecting said link plate to said door-half plate, and an elongated track member and track guide hold-open door check mechanism, the combination further comprising:

said body-half hinge plate having an upstanding mounting portion provided with an aperture for mounting said guide mechanism thereon with said guide mechanism slidably receiving said track member, said track member adapted for releasable engagement with the guide mechanism, said track member having one end thereof projecting from said guide mechanism and through said mounting aperture, and means for pivotally attaching said track member one end to said link plate;

whereby upon the vehicle door being moved between a closed position and an open position that is displaced from the closed position by a predetermined angle said track member engaging said guide mechanism so as to releasably maintain the door in said open position; and whereby with said door in said open position said link plate being adapted for detachment from said door-half hinge plate such that said door and door-half hinge plate adapted for separation from the vehicle body and said body-half hinge subassembly without the need of dissembling said elongated track member and track guide hold-open door check mechanism.

2. The hinge assembly as set forth in claim 1 wherein said guide mechanism comprising guide rollers disposed on either side of said track member passing therebetween, said track member having a roller trough therein, and whereby upon the door being moved from its closed position to said open position said track trough engaging one of the guide rollers so as to maintain the door in said open position.

3. The hinge assembly as set forth in claim 1 wherein said body-half hinge plate having a generally U-shape when viewed in vertical section providing a first pair of upper and lower parallel flanges extending generally longitudinally from a vertically disposed bight wall, flange means integral with said body-half hinge plate adapted for its support on the vehicle body, and said bight wall forming said mounting portion.

4. The hinge assembly as set forth in claim 1 wherein said track member having stop means secured to an opposite end thereof.

5. The hinge assembly as set forth in claim 1 wherein said door-half hinge plate having a generally U-shape when viewed in vertical section providing a pair of upper and lower parallel flanges extending outwardly from a vertically disposed bight wall, said door-half hinge plate secured to said door;

said link plate having one end detachably secured to said door-half hinge plate and an opposite end pivotally connected to a pair of upper and lower flanges of said body-half hinge plate, said link plate provided with a horizontally disposed attachment tab positioned adjacent its pivot end juxtaposed said track member one end whereby said tab having a hole therein adapted for alignment with a hole in said track member one end for reception of said hinge pin therethrough providing a pivotal connection therebetween.

6. The hinge assembly as set forth in claim 4 wherein said link plate being generally U-shaped when viewed in vertical section and having upper and lower parallel flanges extending from a bight wall, said link plate bight wall sized for reception between said door-half hinge plate upper and lower flanges such that a distal end of said link plate projects from a free end of said door-half hinge plate for reception between the upper and lower flanges of said body-half hinge plate, and said hinge pin extending through aligned holes in said body-half hinge plate upper and lower flanges and aligned holes in said link plate upper and lower flanges.

7. The hinge assembly as set forth in claim 6 wherein each said link plate bight wall and said door-half bight wall formed with a predetermined arcuately shaped configuration when viewed in horizontal section such that said link plate bight wall outer surface is adapted to nested in a complementary manner with said door-half bight wall inner surface.

8. The hinge assembly as set forth in claim 7 wherein said door-half hinge plate pair of flanges defining a vertical clearance space therebetween having a predetermined height slightly greater than the combined height of the link plate pair of flanges and wherein a coupling dowel depending from an underside of said door-half hinge plate upper flange, thereby enabling the link plate bight wall exterior surface to be positioned in nested relation with the interior surface of said door-half bight wall, and removable fastener means securing said nested link plate and body-half plate bight walls in locked engagement for conjoint swinging movement about said hinge pin relative to said door-half hinge plate.

9. The hinge assembly as set forth in claim 8 wherein said door-half hinge plate upper flange having a coupling dowel depending from an undersurface thereof, and wherein said link plate upper flange having a hole positioned to receive said dowel therein, and said link plate bight wall outer surface adapted for predetermined positioning relative to door-half bight wall interior surface;

whereby upon the door being moved horizontally said body-half hinge sub-assembly having its pivotally attached link plate initially received in a predetermined fixed manner within said door-half hinge plate such that an undersurface of said link plate lower flange juxtaposed an interior surface of said door-half lower flange, whereby upon the door being vertically lowered said door-half plate dowel being received in said link plate upper flange dowel hole, wherein associated pairs of holes in said link plate bight wall and said door-half bight wall are aligned for receiving therethrough releasable fastener means thereby readily securing said link plate and door-half hinge plate for conjoint swinging movement about said hinge pin relative to said body-half mounting plate.

10. The hinge assembly as set forth in claim 4 wherein said link plate being generally U-shaped when viewed in vertical section and having upper and lower parallel flanges extending from a bight wall, said link plate bight wall and said door-half hinge plate bight wall each having a complementary central arcuate-shaped portion in horizontal section, each said link plate and said door-half hinge plate central portion terminating in linear sections so as to define planes which intersect at matching obtuse angles of the order of 110 degrees permitting juxtaposed nesting therebetween.

* * * * *